US008201750B2

(12) United States Patent
Sambrook

(10) Patent No.: US 8,201,750 B2
(45) Date of Patent: Jun. 19, 2012

(54) FUEL ECONOMIZER IMPROVEMENTS

(76) Inventor: James Edward Sambrook, Hampshire (GB)

( * ) Notice: Subject to any disclaimer, the term of this patent is extended or adjusted under 35 U.S.C. 154(b) by 572 days.

(21) Appl. No.: 12/508,631

(22) Filed: Jul. 24, 2009

(65) Prior Publication Data

US 2010/0025489 A1 Feb. 4, 2010

Related U.S. Application Data

(63) Continuation-in-part of application No. 12/181,339, filed on Jul. 29, 2008, now Pat. No. 7,913,927.

(51) Int. Cl.
*G05D 23/32* (2006.01)
*F24H 9/20* (2006.01)
*F24F 11/04* (2006.01)

(52) U.S. Cl. ..... 236/1 A; 236/10; 236/46 E; 236/47; 165/247

(58) Field of Classification Search ..... 236/1 A, 236/10, 46 R, 46 E, 47; 165/244, 247, 267
See application file for complete search history.

(56) References Cited

U.S. PATENT DOCUMENTS

| | | | | |
|---|---|---|---|---|
| 4,136,730 | A | 1/1979 | Kinsey | |
| 4,333,519 | A * | 6/1982 | Shafrir et al. | 165/259 |
| 4,369,916 | A | 1/1983 | Abbey | |
| 4,381,075 | A * | 4/1983 | Cargill et al. | 237/8 R |
| 4,408,711 | A | 10/1983 | Levine | |
| 4,667,874 | A | 5/1987 | Johnson et al. | |
| 4,842,044 | A | 6/1989 | Flanders et al. | |
| 5,244,146 | A * | 9/1993 | Jefferson et al. | 236/11 |
| 7,913,927 | B2 * | 3/2011 | Sambrook | 236/46 E |

* cited by examiner

*Primary Examiner* — Marc Norman
(74) *Attorney, Agent, or Firm* — Louis Ventre, Jr.

(57) ABSTRACT

An electronic circuit for a hot water heating system an override thermostat; a timer operable to deactivate and reactivate the burner while a room thermostat is calling for heat; a differential temperature switch configured to disconnect the electrical supply to the water pump when the difference in temperature between the water at the boiler inlet and the water at the boiler outlet falls below an adjustable set point; and, a temperature switch configured to prevent operability of the timer until the temperature of the water at the burner outlet rises above an adjustable set point.

2 Claims, 1 Drawing Sheet

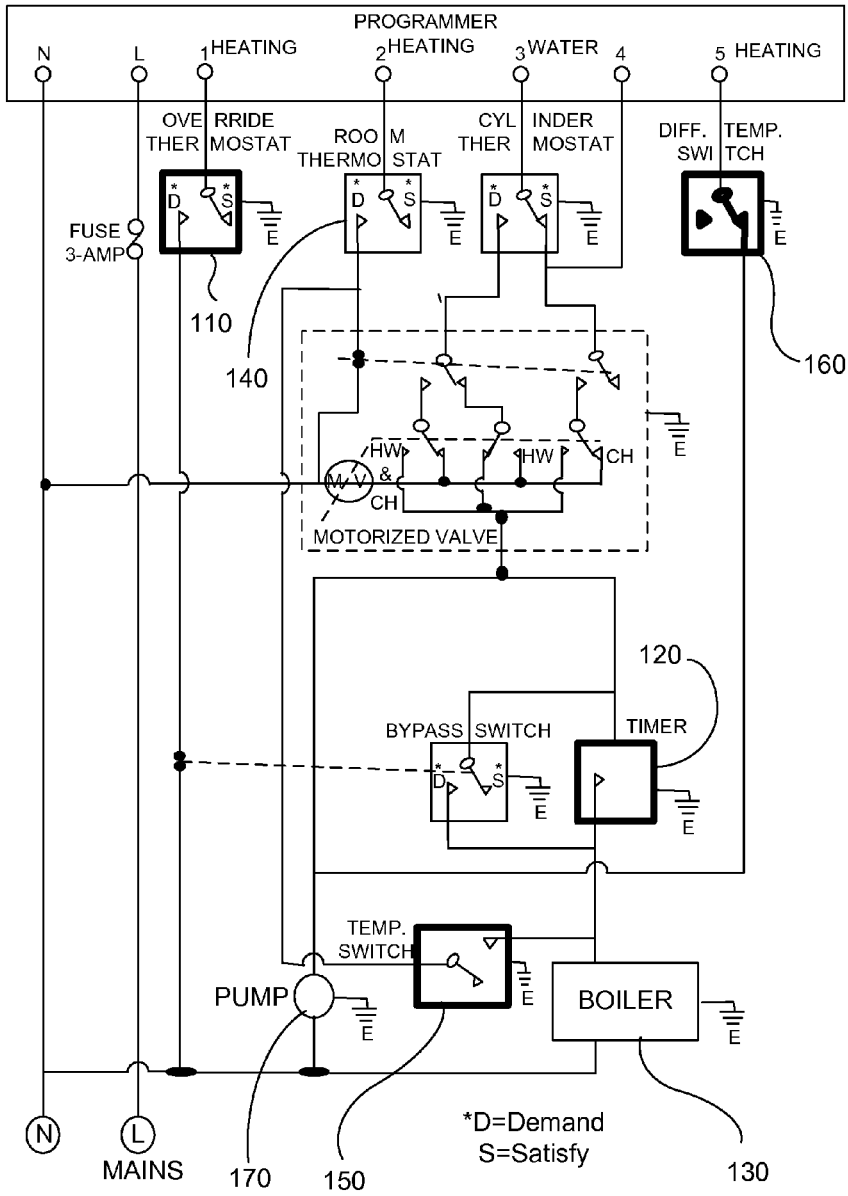
PROGRAMMER
N
L
1 HEATING
2 HEATING
3 WATER
4
5 HEATING
OVERRIDE THERMOSTAT
ROOM THERMOSTAT
CYLINDER THERMOSTAT
DIFF. TEMP. SWITCH
FUSE 3-AMP
D
S
E
110
140
160
HW
CH
MV
MOTORIZED VALVE
120
BYPASS SWITCH
TIMER
TEMP. SWITCH
PUMP
BOILER
MAINS
170
150
130
*D=Demand
S=Satisfy

FUEL ECONOMIZER IMPROVEMENTS

CROSS-REFERENCE TO RELATED APPLICATIONS

This application is a continuation-in-part of application Ser. No. 12/181,339, filed 29 Jul. 2008, which is hereby incorporated by reference herein.

TECHNICAL FIELD

In the field of heat exchange, a device is disclosed to increase the efficiency of a heating system in transferring heat using an auxiliary thermostat and timer to create additional temperature cycles for the heat exchanger.

BACKGROUND ART

This is an invention improving the heating system fuel economizer disclosed in the parent application, referenced above. The parent application discloses a device that implements repeated burner-on cycles within the heating cycle in order to increase heat transfer efficiency and reduce fuel consumption to deliver the same heating performance. The increase in efficiency is most effectively achieved in hot-water heating systems, testing of which had indicated a fuel or energy efficiency increase of up to 50%, that is, a reduced fuel consumption for the same heating demand of up to 50%.

As with the parent invention, an improvement in heat exchange efficiency afforded by this invention is also applicable to other types of heating systems including forced air heating. However, the improvement attributable to heat transfer efficiency also afforded by this invention cannot be applied to heating systems other than hot-water heating systems where the means of heat transfer is not by circulating hot water. Thus, the level of efficiency improvement for forced air heating will not be as high as with hot-water heating systems. This is apparent when it is understood that with hot-water systems, any heat not transferred from the water to the indoor air is returned to the boiler. With forced air systems, the air passing through the heat exchanger is delivered directly into the living space and therefore not returned via a closed system.

The discussion hereinafter is limited to hot-water heating systems with the understanding that the principles discussed may be applied to other heating systems.

The improvements of the present invention have also been tested to deliver an energy efficiency increase up to about 55% over hot water heating systems operating in the traditional fashion without the fuel economizer, as improved by the present invention. The present invention, thus, represents an improvement in energy efficiency of up to 5% above the fuel efficiency delivered by the fuel economizer of the parent invention.

The level of heating in a home is usually controlled by a room thermostat which has set upper and lower temperature limits. When the indoor temperature reaches the upper limit the room thermostat shuts the boiler burner down and when the indoor temperature falls to the lower limit it brings the burner on again. A complete heating cycle comprises a burner-on stage and a burner-off stage and the duration of one cycle is the length of time between the burner coming on at the beginning of one cycle and the burner coming on at the beginning of the next cycle.

The burner-on stage of the cycle may be divided into two phases. Phase I is the initial heat-up phase and Phase II is the constant heat phase. When the burner comes on at the start of Phase I, much of the heat supplied is absorbed by the heat exchanger and the remainder is lost via the flue. The heat exchanger then passes its heat on to the circulating water.

Initially the heat exchanger is relatively cool. The difference in temperature between the hot gases and the heat exchanger is at its highest and the rate of heat absorbed is greatest. As the heat builds up in the heat exchanger, the temperature-rise of the water between the inlet and outlet of the boiler gradually increases. Eventually the temperature of the heat exchanger and the water temperature-rise reach constant values. Phase II then commences and these levels are maintained until the end of the heating period when the burner cuts out.

Testing with the fuel economizer disclosed in the parent application has proved that in practice heat otherwise lost can be reclaimed in both Phases I. and II.

The invention of the parent application works by interrupting the electrical supply to the burner while the room thermostat is still calling for heat, the burner shuts down but the circulating water pump continues to run. This means that the water, which is still circulating, absorbs the residual heat from the heat exchanger and passes it on to the indoor air with no further heat energy being supplied from the burner. After a suitable period the electrical supply is reinstated bringing the burner on again. This on/off process is repeated until the burner is shut down by the room thermostat.

In order to enable the heating system to operate in this way, the parent application teaches that a timer is installed in the electrical supply to the burner. An override thermostat is also installed so that, in extremely cold outside conditions, if the Fuel Economizer is unable to maintain the room temperature, this override thermostat will take over and bring the room temperature up to the required level, at which point the Fuel Economizer will once again take over.

SUMMARY OF THE INVENTION

The present invention adds 2 new components to the electronic circuit of the parent application for a total of 4 components added to the typical electronic circuitry for a heating system. The two new components are: a differential temperature switch and a temperature switch. The two components from the parent application are an override thermostat and a timer.

The invention is an electronic circuit to conserve fuel consumption and reduce carbon dioxide emissions in a typical hot water heating system. The heating system comprises a boiler that heats water, the boiler comprising a burner and a heat exchanger with a water inlet and a water outlet. The heating system further comprises a water pump powered by an electrical supply; and, a room thermostat comprising a setting for a lower temperature limit and an upper temperature limit. The room thermostat is operable to activate the burner upon detecting a room temperature at or below the lower temperature limit and deactivate the burner upon detecting a room temperature at or above the upper temperature limit.

The electronic circuit comprises an override thermostat comprising a setting for a lower temperature limit and an upper temperature limit below those of the room thermostat. The override thermostat is operable to activate continuous operation of the burner until the upper temperature limit of the override thermostat is reached when the indoor temperature falls below the lower temperature limit of the room thermostat.

The electronic circuit further comprises a timer operable to deactivate and reactivate the burner while the room thermostat is calling for heat.

The electronic circuit further comprises a differential temperature switch configured to disconnect the electrical supply to the water pump when the difference in temperature between the water inlet of the heat exchanger and the water outlet of the heat exchanger falls below an adjustable set point.

The electronic circuit further comprises a temperature switch configured to prevent operability of the timer until the temperature of the water at the heat exchanger outlet rises above an adjustable set point.

Technical Problem

Excess operating costs in a home heating system and unnecessary air pollution are attributable to heat exchange inefficiency between the burner and circulating water due to standing losses, and to heat transfer inefficiency between circulating water and indoor air.

Heat transfer between circulating water and indoor air is more efficient if all of the heat absorbed by the water when it leaves the boiler is transferred to the indoor air before the water is returned to be reheated by the boiler.

However, with most central heating systems, the water returns to the boiler for reheating still containing a substantial amount of heat, which has the effect of raising the boiler inlet water temperature but reducing heat transfer efficiency. Improved heat transfer efficiency will be achieved if the water is recirculated a second or even third time without adding more heat.

Current technology attempts to increase efficiency in fuel combustion by fitting boilers with induced draft fans designed to increase the influx of oxygen. Such an approach can be somewhat counterproductive because it increases the velocity of gases leaving the boiler. This reduces the dwell time of these gases in the vicinity of the heat exchanger, which reduces the efficiency of heat exchange. Additionally, the higher the emission velocity of gas from the burner the lower the heat absorbed by the heat exchanger with consequent loss of useful heat.

Solution to Problem

During the continuous burner-on period of the standard heating cycle, heat is used to build up and maintain the temperature of the heat exchanger body. This heat which would otherwise be lost via the flue can be reclaimed and conserved by having one or more shorter burner-on periods within the heating cycle. Each time the burner goes off, the water pump continues to run and circulate water. The pump continues running after the room thermostat has stopped calling for heat until the differential temperature switch cuts it out later on in the burner-off period, i.e., the rest stage, of the cycle.

Continued water pump operation enables the water to absorb the residual heat in the heat exchanger as well as the heat in the surrounding hot gases and to pass it on to the indoor air. The addition of a differential temperature switch enables finer control of the operational period of the water pump to cut it off when water circulation through the heat exchanger will not significantly add heat to the water. The water pump, therefore, operates for a longer period with the improvements of the present invention than with the Fuel Economizer of the parent invention. With the present invention, more electricity is used to run the pump longer, but the increased heat transfer efficiency far outweighs the cost of electricity. During the burner-off periods, the exit velocity of the hot gases and the rate of heat emission from the heat exchanger are reduced by virtue of the burner being off and the natural or induced draft being reduced. Also the cooling effect of the incoming air to support combustion is much less.

In addition, improvements are obtained in a heating system by reclaiming residual heat otherwise lost; by using circulating water at an elevated temperature; and by prolonging the burner-off period of the heating cycle.

Advantageous Effects of Invention

The invention, called the Fuel Economizer, may be incorporated in the design of new boilers and central heating systems to improve their efficiency substantially. However a significant benefit of the invention is achieved when it is applied to existing heating systems already in the marketplace. This is where huge savings can be made in fuel usage and reductions in carbon dioxide emissions worldwide. The invention delivers advantages due principally to enabling three operating conditions for the heating system. These are: operating at an elevated circulating water temperature; prolonging the initial burner operation; and, prolonging the burner-off period of the heating cycle.

The practical effect of operating at an elevated circulating water temperature is that there is more efficient heat transfer between the water and the room air by virtue of the greater temperature differential between them. There is more heat contained in the water and it transfers more quickly to the air. This greater efficiency is initially somewhat offset by the extra energy used to raise the water temperature to a higher level. However, once that higher temperature level is reached, the energy invested in raising and sustaining that level will contribute to greater overall efficiency, provided that level is sustained for a long enough period.

A break-even point is reached after a specific period of time when the overall heat transfer efficiency at the higher water temperature is the same as that when operating at a lower water temperature. When the duration of the heating stage of the heating cycle goes beyond that point, the overall heat transfer efficiency rises above that which it would otherwise be. It, thus, will be seen that in order to achieve this higher water temperature, the burner needs to be on for a prolonged period of time beyond that which the action of the room thermostat would normally switch off the burner.

To prolong the period of initial burner operation, a room thermostat would have an enlarged temperature difference between the upper and lower set points of at least about 1 degree Centigrade. A typical temperature difference is a fraction of a degree Centigrade. This enlarged temperature difference creates the extra length of time needed to accommodate the initial prolonged burner-on period as well as allowing time for the intermittent burner operation that follows using the present invention. Because the burner-on period has been prolonged, the burner-off period of the heating cycle may also be extended, saving fuel and reducing pollution.

To enable the initial prolonged period of burner operation, a temperature switch is added to the circuit. This temperature switch is introduced into the circuit in a bypass around the timer. When the burner comes on at the beginning of the heating cycle, the switch remains closed until the water temperature reaches the pre-set value. The switch then opens and control is handed over to the timer. This ensures that for the first few minutes the electrical supply to the burner is uninterrupted. Thereafter, the timer takes over so that the burner operates intermittently until the room temperature is satisfied and the thermostat cuts the burner out. The temperature switch operates over an adjustable temperature differential, so that the switch will not close again until the water temperature falls below the pre-set value, such as 10 degrees Centigrade below the pre-set value.

By prolonging the burner-off period of the heating cycle, greater energy efficiency is achieved by reducing the proportion of burner-on time for the complete heating cycle. While the burner is off, the pump that circulates the water remains on, long after the room thermostat would have otherwise switched off the burner. This is functional because the circulating water draws a substantial amount of residual heat from the heat exchanger, which would otherwise be lost via the flue. By allowing the pump to run on, this heat is transferred to the water and then on to the indoor air. Although there is insufficient heat to maintain the indoor temperature, the extra heat supplied significantly delays the fall of the indoor temperature to the room thermostat cut-in set point.

In a test of a heating system with and without the invention in an existing installation, the results showed reduced fuel consumption and carbon dioxide emissions of about 55 percent.

Thus, the invention achieves substantial improvements in efficiency, energy use and pollution of the environment by reducing burner operation. The invention also reduces excess water-heating system costs, thus reducing consumer fuel bills. The invention also minimizes consumer inconvenience when introduced to a heating system that otherwise would continue to send heat to a room after the desired room temperature setting has been achieved.

BRIEF DESCRIPTION OF DRAWING

The drawing is a schematic of electric circuitry typically operable in a water-heating system and showing the added circuitry of the invention in a preferred embodiment.

DESCRIPTION OF EMBODIMENTS

In the following description, reference is made to the accompanying drawing, which forms a part hereof and which illustrates a preferred embodiment of the present invention. The drawing and the preferred embodiment of the invention is presented with the understanding that the present invention is susceptible of embodiments in many different forms and, therefore, other embodiments may be utilized and structural, and operational changes may be made, without departing from the scope of the present invention.

The drawing is an exemplary schematic of electric circuitry typically operable in a water-heating system integrated with the added electronic circuit of the invention. The purpose of the added electronic circuit is to conserve fuel consumption and reduce carbon dioxide emissions in a heating system that comprises a boiler (130) that heats water. The boiler (130) comprises burner and a heat exchanger. The heat exchanger has a water inlet and a water outlet. The heating system further comprises a water pump (170) powered by an electrical supply; and, a room thermostat (140). A water pump (170) present in all such systems delivers hot water for heating. The room thermostat (140), as is common in such applications, comprises a setting for a lower temperature limit and an upper temperature limit and is operable to call for heat and thus activate the boiler (130) upon detecting a room temperature at or below the lower temperature limit and deactivate the burner upon detecting a room temperature at or above the upper temperature limit.

The electronic circuitry of the invention, which is added to electric circuitry typically operable in a water-heating system, comprises an override thermostat (110); a timer (120); a differential temperature switch (160); and, a temperature switch (150).

The override thermostat (110) is similar to the room thermostat (140) in that it comprises a setting for a lower temperature limit and an upper temperature limit. The lower temperature limit and an upper temperature limit of the override thermostat (110) are set below their respective settings on the room thermostat (140).

An important operability of the override thermostat (110) occurs when the indoor temperature falls below the lower temperature limit of the room thermostat (140). In that circumstance, the override thermostat (110) is operable to activate continuous operation of the boiler (130) until the upper temperature limit of the override thermostat (110) is reached. The upper temperature limit of the override thermostat (110) would optimally be set a few degrees below the upper temperature limit of the room thermostat (140) so that the residual energy in the water and heat exchanger would be used to raise the room temperature to the upper temperature limit set on the room thermostat (140).

Once the upper temperature limit of the override thermostat (110) is reached, with the room thermostat (140) still calling for heat, the timer (120) again takes over control of the boiler (130) "on" and "off" periods. Once the upper limit on the override thermostat (110) has been reached, the timer by-pass switch opens thus allowing the timer (120) to dictate when the boiler (130) is on and off. The upper temperature limit set on the override thermostat (110) is deliberately set below that of the room thermostat (140) so that when the upper temperature limit set on the override thermostat (110) is reached the room thermostat (140) is still calling for heat. The room thermostat (140) circuit, which incorporates the timer (120), the boiler (130) and the water pump (170), then takes over control and the invention comes back into play. In the preferred embodiment, it is not possible for the boiler (130) to fire if the room thermostat (140) is not calling for heat since the room thermostat (140) cuts off the power supply to both the boiler (130) and the timer (120). Preferably, the timer (120) operates using a switch on the electrical supply to the boiler (130) located downstream of a room thermostat (140) switch. Thus, the timer (120) will still go through its paces but will have no effect on boiler (130) operation until the room thermostat (140) restores electricity to the timer (120).

In normal operation in very cold weather, the override thermostat (110) comes on because the indoor temperature has fallen below the cut-in point, which is the lower temperature limit, of the room thermostat (140). This means that the boiler (130) on-periods controlled by the timer (120) are not sufficient to provide enough heat to cope with severe outside conditions. When the lower temperature limit of the override thermostat (110) is reached, a timer (120) by-pass switch closes and takes the timer out of circuit. This means that as long as the override thermostat (110) is active, the boiler (130) is on continuously. At this point, the room thermostat (140) is still calling for heat. The indoor temperature will quickly rise to the upper temperature limit of the override thermostat (110) when the timer (120) by-pass switch will open and bring the timer (120) back into circuit. Because the upper temperature limit on the room thermostat (140) is set above that of the override thermostat (110), the room thermostat (140) is still calling for heat. Hence the timer (120) once again dictates the boiler (130) on-period and boiler (130) off-period.

The timer (120) is operable to deactivate and reactivate the burner while the room thermostat (140) is calling for heat. The room thermostat (140) is calling for heat when it detects a room temperature below its lower temperature limit. Effectively, the timer (120) predetermines the "off" and "on" periods of the boiler (130) within the standard cycle dictated by the room thermostat (140). Thus, in preferred embodiments, the timer (120) alternately interrupts and reinstates the electrical supply to a chosen circuit, for example to a circuit controlling the burner, or to a chosen device, such as the boiler (130). For a preferred embodiment, the timer (120) operates on the electrical supply to the boiler (130). The timer (120) preferably has a wide range of "on" and "off" period settings from a few seconds to many hours.

The differential temperature switch (160) is configured to disconnect the electrical supply to the water pump (170) when the difference in water temperature between the water at the water inlet of the heat exchanger (130) and the water at the water outlet of the heat exchanger (130) falls below an adjustable set point. In other words, this switch senses the difference in temperature between the boiler water inlet and outlet temperatures. The switch remains closed until the water temperature falls to the adjustable set point temperature. The differential temperature switch (160) then opens disconnecting the electrical supply to the water pump (170) and stopping it.

The temperature switch (150) is configured to prevent operability of the timer (120) until the temperature of the water at the boiler (130) outlet rises above an adjustable set point. In other words, the temperature switch (150) senses the boiler outlet water temperature. Temperature switch (150) remains closed until the boiler outlet water temperature rises to a predetermined temperature, which is adjustable. This bypasses the timer (120) until the pre-set temperature is reached. Temperature switch (150) then opens, thus enabling operability of timer (120).

Thus, in preferred embodiments, the burner cannot operate if the room thermostat (140) is not calling for heat; the override thermostat (110) can only operate when the room thermostat (140) is calling for heat; and, the override thermostat (110) cannot cause the burner to fire independently of the room thermostat (140). Operationally, the override thermostat's (110) lower set point is set below that of the room thermostat (140). In very cold outside temperatures, the Fuel Economiser may not be able to maintain the indoor temperature so that it falls below the room thermostat's (140) lower set point. When this happens, the override thermostat (110) cuts in and operates a switch on a bypass around the timer (120). This ensures the boiler (130) remains on until the upper set point is reached. At this point control is handed back to the room thermostat (140) and the Fuel Economizer.

The added circuit of the invention delivers operational benefits. With the boiler (130) deactivated, that is the burner is off and not firing, the influx of relatively cold combustion air is reduced to a minimum, especially if the boiler (130) has an induced-draught fan. As a consequence, the rate of cooling of the heat exchanger is also reduced, providing more residual heat in the heat exchanger available to heat water circulated by the water pump (170). Additionally, with both the boiler (130) and the induced-draught fan deactivated, the exit velocity of hot gases is less, increasing the dwell time and again slowing down the dissipation of heat from the heat exchanger and providing more heat for transfer to circulating water.

The increased burner-off time also means increased off time of the induced-draught fan, when one is present in the heating system. This further reduces use of electrical energy and results in added savings in energy consumption and reduced carbon dioxide emissions.

Since the timer (120) will activate the boiler (130) or its circuit only when the room thermostat (140) is calling for heat, the boiler (130) will not be activated if heat is not being called for by the room thermostat (140). This operational limitation prevents unnecessary operation of the boiler (130), wasted heat, unnecessary fuel consumption and generation of combustion pollution when heat is not being called for by the room thermostat (140).

The burner "on" and "off" periods provided by the timer can occur several times during what otherwise would have been a single heating cycle operated by a single room thermostat (140). The water pump (170) runs continuously while the room thermostat (140) is calling for heat but also during the burner-off period until the differential temperature switch (160) cuts it out. Operation of the water pump (170) is changed with respect to the applicant's original invention described in the parent application because the water pump (170) stays on longer and cuts off by action of the differential temperature switch (160), which increases heating efficiency and lowers costs by transferring more heat from the water, despite added costs for electricity in running the water pump (170) for a longer period. The water pump (170) is turned off when the difference in temperature between the water inlet and water outlet of the heat exchanger is too small for efficient heat transfer. In addition, the benefits over the prior art with no Fuel Economizer are twofold as has been shown in practice: heat is reclaimed, which would otherwise be lost; and the overall burner-off time is greater. Fuel is therefore conserved and air pollution reduced.

EXAMPLE 1

Two in-situ tests were conducted on a boiler typical of many installed in households in the United Kingdom and many other countries. Both tests were carried out during the hours of darkness in order to eliminate the possible effects of solar gain. Test 1 involved a typical central heating system that was run normally in it's "as installed" state. Test 2 involved the same central heating system, but run with the circuitry of the present invention.

The prevailing conditions during each test were virtually identical but with the differential temperature between inside and out slightly favouring the "as installed" test at 19.8 degrees Centigrade compared with 20.4 degrees Centigrade in the test with the present invention.

In Test 1, the central heating system had already been operating for some time in the central heating mode when readings started to be taken. The room thermostat entirely dictated the burner-on and burner-off times throughout a 5-hour-plus test period. The room temperature was maintained at between 22.6 degrees Centigrade and 22.9 degrees Centigrade. The total burner-on time was 157 minutes and the total burner-off time was 195 minutes.

In Test 2, the central heating system had been off for a period before starting the test. Consequently, the boiler water temperature was quite low; 12.2° C. This meant that the boiler outlet water temperature at the end of the initial heating period at 51.2 degrees Centigrade took longer to reach and the burner was therefore on for a longer period. At the end of the test cycle the boiler outlet water temperature had fallen to approximately 27 degrees Centigrade. The second cycle would therefore have started with the water temperature 15 degrees Centigrade higher. The burner would therefore have been on for a shorter period thus improving even further the heat transfer efficiency!

After the initial continuous heating period of 14 minutes 30 seconds, the intermittent stage of the heating period kicked in with the burner on for 3 minutes 13 seconds on average and off for 3 minutes 16 seconds, repeatedly. The room temperature started the test at 22.1 degrees Centigrade and the room thermostat ended the heating stage of the cycle with the room temperature at 23.1 degrees Centigrade; 1.0 degree Centigrade higher. The room temperature was maintained at between 22.1 degrees Centigrade and 23.2° degrees Centigrade. The total burner-on time was 39 minutes and the total burner-off time was 156 minutes.

To enable fair comparison to be made between the two performances, the total burner-on times are calculated over a 24-hour period.

For Test 1, the total duration of test was 352 minutes, which calculates to a burner-on time over 24 hours of 642 minutes.

For Test 2, the total duration of test was 194.3 minutes, which calculates to a burner-on time over 24 hours of 286.6 minutes.

Thus, the actual reduction in burner-on time due to the invention was 355.4 minutes, which is the difference between 642 minutes in Test 1 and 286.6 minutes in Test 2. This equates to a percentage reduction in fuel consumption and carbon dioxide production of 55.4 percent.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

INDUSTRIAL APPLICABILITY

The invention has application to the heating system industry.

What is claimed is:

1. An electronic circuit to conserve fuel consumption and reduce carbon dioxide emissions in a heating system that comprises a boiler that heats water, the boiler comprising a burner and a heat exchanger with a water inlet and a water outlet; a water pump powered by an electrical supply; and, a room thermostat comprising a setting for a lower temperature limit and an upper temperature limit wherein the room thermostat is operable to activate the burner upon detecting a room temperature at or below the lower temperature limit and deactivate the burner upon detecting a room temperature at or above the upper temperature limit, the electronic circuit comprising:

an override thermostat comprising a setting for a lower temperature limit and an upper temperature limit below the respective lower temperature limit and upper temperature limit of the room thermostat and operable to activate continuous operation of the burner when the room temperature falls below the lower temperature limit of the override thermostat and until the upper temperature limit of the override thermostat is reached;

a timer operable to deactivate and reactivate the burner while the room thermostat is calling for heat;

a differential temperature switch configured to disconnect the electrical supply to the water pump when the difference in water temperature between the water inlet of the heat exchanger and the water outlet of the heat exchanger falls below an adjustable set point; and a temperature switch configured to prevent operability of the timer until the temperature of the water at the water outlet of the heat exchanger rises above an adjustable set point.

2. The electronic circuit of claim 1 wherein the timer is operable to deactivate and reactivate the burner by interrupting and restoring electrical supply to a circuit controlling the burner.

* * * * *